US007195216B2

(12) United States Patent
Wang

(10) Patent No.: US 7,195,216 B2
(45) Date of Patent: Mar. 27, 2007

(54) ADJUSTABLE TRUNK FOR AN ARTIFICIAL CHRISTMAS TREE

(75) Inventor: Sheng-Chien Wang, Shenkang Hsiang (TW)

(73) Assignee: Gemmy Industries Corporation, Coppell, TX (US)

( * ) Notice: Subject to any disclaimer, the term of this patent is extended or adjusted under 35 U.S.C. 154(b) by 291 days.

(21) Appl. No.: 11/009,860

(22) Filed: Dec. 10, 2004

(65) Prior Publication Data

US 2006/0124819 A1 Jun. 15, 2006

(51) Int. Cl.
*F16M 11/00* (2006.01)

(52) U.S. Cl. ..... 248/157; 248/161

(58) Field of Classification Search ..... 248/132, 248/161, 157, 125.1, 125.2; 52/121; 343/874, 343/875, 883; 254/334, 337, 398
See application file for complete search history.

(56) References Cited

U.S. PATENT DOCUMENTS

| | | | | | |
|---|---|---|---|---|---|
| 2,371,539 | A * | 3/1945 | Morch | 343/876 |
| 2,795,303 | A * | 6/1957 | Muehlhause et al. | 52/121 |
| 2,983,474 | A * | 5/1961 | Hanna | 248/161 |
| 3,248,831 | A * | 5/1966 | Jones | 52/121 |
| 3,575,368 | A * | 4/1971 | Thomas et al. | 248/572 |
| 3,891,184 | A * | 6/1975 | Fields | 254/4 R |
| 3,952,467 | A * | 4/1976 | Partlow | 52/121 |
| 4,151,534 | A * | 4/1979 | Bond | 343/883 |
| 4,176,360 | A * | 11/1979 | Leavy et al. | 343/883 |
| 4,258,825 | A * | 3/1981 | Collins | 182/14 |
| 4,508,316 | A * | 4/1985 | Millard | 254/4 R |
| 4,580,377 | A * | 4/1986 | Sundin | 52/121 |
| 4,600,348 | A * | 7/1986 | Pettit | 414/11 |
| 4,785,309 | A * | 11/1988 | Gremillion | 343/883 |
| 5,101,215 | A * | 3/1992 | Creaser, Jr. | 343/883 |
| 5,114,109 | A * | 5/1992 | Fitz et al. | 248/404 |
| 5,218,375 | A * | 6/1993 | Hillman | 343/883 |
| 5,533,593 | A * | 7/1996 | Huang | 182/141 |
| 6,234,453 | B1 * | 5/2001 | Block | 254/285 |
| 6,460,795 | B1 * | 10/2002 | Brown, Jr. | 242/378.2 |
| 2005/0133077 | A1 * | 6/2005 | Zerillo | 135/20.3 |

* cited by examiner

*Primary Examiner*—A. Joseph Wujciak, III
(74) *Attorney, Agent, or Firm*—patenttm.us; James H. Walters

(57) ABSTRACT

An adjustable trunk for an artificial Christmas tree has a base, a telescoping post and a reel assembly. The telescoping post has a stationary outer tube, at least two inner tubes and multiple gaps. The stationary outer tube is mounted on the base. The inner tubes are mounted slidably inside the stationary outer tube and each other. Each tube has a top end, at least one longitudinal slot, at least one bridge, a bottom end and a reeve hole. The gaps are defined between adjacent tubes. The reel assembly has a reel and at least one cable. The at least one cable extends over the top end of the outer tube, through the gap between the stationary outer tube and an adjacent inner tube, through the reeve hole, up the adjacent gap and continues until being attached to the reeve hole in the innermost inner tube.

3 Claims, 8 Drawing Sheets

ADJUSTABLE TRUNK FOR AN ARTIFICIAL CHRISTMAS TREE

BACKGROUND OF THE INVENTION

1. Field of the Invention

The present invention relates to an artificial tree, and more particularly to an adjustable trunk for a Christmas tree that can be adjusted in height.

2. Description of Related Art

Large Christmas trees are important decorations for celebrating Christmas and for displaying Christmas ornaments in many markets and stores to attract customer's attention. A conventional trunk for a large, artificial Christmas tree is simply comprise a base and a pole mounted on the stand. Multiple branches are attached to the pole to form the Christmas tree. However, the pole cannot be extended or retracted so that the Christmas tree is not convenient to assemble or disassemble.

To overcome the shortcoming of the conventional trunk for the artificial Christmas tree described, an adjustable trunk is provided. The present invention mitigates or obviates the disadvantages of the conventional trunk.

SUMMARY OF THE INVENTION

The main objective of the present invention is to provide an adjustable trunk for an artificial Christmas tree, which is retractable to make the trunk convenient to transport or assemble.

To achieve the foregoing objective, the adjustable trunk comprises a base, a telescoping post and a reel assembly.

The base has a top face and a cavity.

The telescoping post is mounted on the top face of the base and has a stationary outer tube, multiple inner tubes and multiple gaps. The tubes have different diameters and are connected retractably together. Each tube has a top end and a bottom end, and the gaps are defined between adjacent two tubes.

The reel assembly has a reel and a cable. The reel is mounted in the base and has a prime mover and a spool. The cable is wound on the spool, reeves around the top end of the stationary outer tube, passes down through the gap between the stationary outer tube and an adjacent outermost inner tube of the at least two inner tubes, passes around the bottom end of the outermost inner tube, enters the outermost inner tube and passes upward through the next gap. The cable repeatedly continues to pass over the top end of the sequential inner tubes, down through the gaps, around the bottom ends and up through the sequential gaps until the cable is attached to the bottom end of an innermost inner tube.

By winding the cable onto or off the spool, the inner tubes raised or lowered to a desired height. Therefore, the stand is adjustable in height.

Further benefits and advantages of the present invention will become apparent after a careful reading of the detailed description with appropriate reference to the accompanying drawings.

DETAILED DESCRIPTION OF THE PREFERRED EMBODIMENT

An adjustable trunk for an artificial Christmas tree in accordance with the present invention comprises a base, a telescoping post and a reel assembly. The base has a top face and a cavity. The telescoping post is mounted on the top face of the base and has a stationary outer tube, at least two inner tubes and multiple gaps. The stationary outer tube is mounted on the top face of the base. The inner tubes have different diameters and are mounted slidably inside the stationary outer tube and each other. Each tube has a top end, at least one longitudinal slot, at least one bridge, a bottom end and a reeve hole. The longitudinal slot is formed near the top end, and the bridge closes the longitudinal slot at the top end. The reeve hole is formed through the tube near the bottom end. The gaps are defined between two adjacent inner tubes. The reel assembly has a reel and at least one cable. The reel has a prime mover and at least one spool. The prime mover may be a motor or a manual crank mechanism. The spool is mounted in the cavity in the base. The at least one cable is wound respectively on the at least one spool and extends over the top end of the stationary outer tube, down through the gap between the stationary outer tube and an adjacent outermost inner tube, through the reeve hole at the bottom end of the outermost inner tube, and up through the gap formed by the outermost inner tube and a next inner tube. The cable passes through the slot in the outermost inner tube over the bridge at the top, back down through the same gap, is repeatedly through the other inner tubes and attaches to the reeve hole near the bottom end of the innermost inner tube lastly. Winding the cable onto or off the spool makes the trunk adjustable to any desired height.

Figure 1:
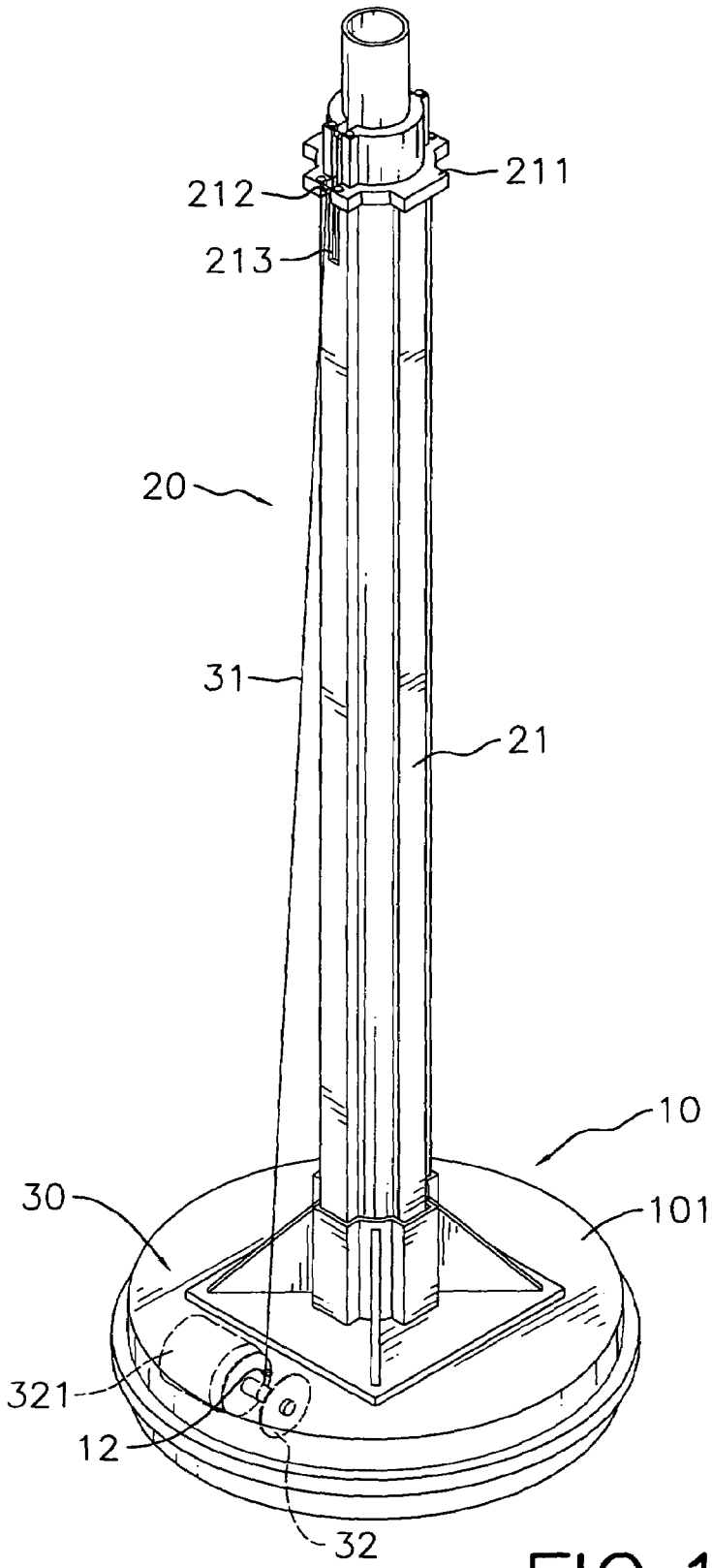
FIG. 1 is a perspective view of an adjustable trunk for an artificial Christmas tree in accordance with the present invention.
Figure 2:
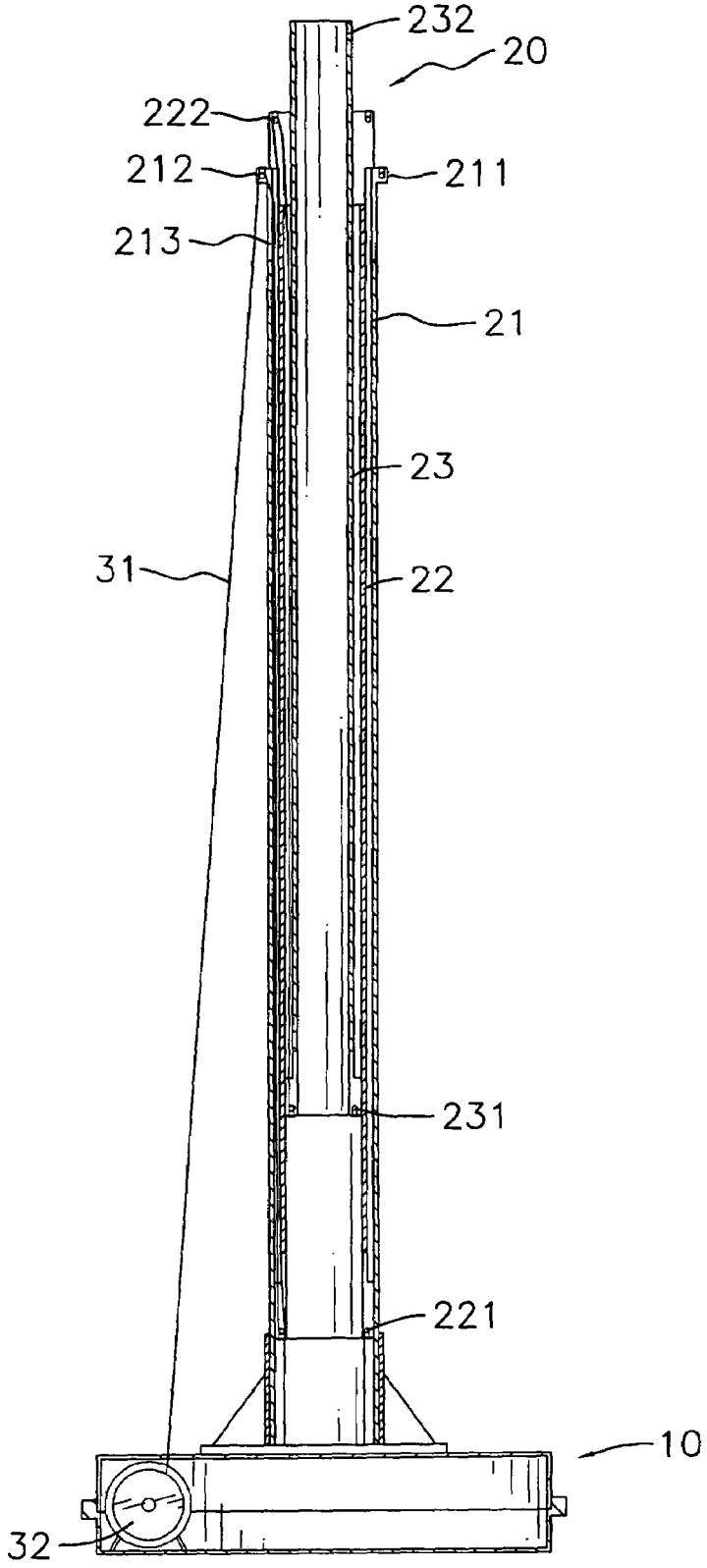
FIG. 2 is a side view in partial section of the adjustable trunk in FIG. 1.

With reference to FIGS. 1, and 2, a preferred embodiment of the adjustable trunk for an artificial Christmas tree comprises a base (10), a telescoping post (20) and a reel assembly (30).

The base (10) is a hollow pedestal, may be round, and has a cavity, a top face (101) and an optional cable hole (12). The top face (101) has a center. The cable hole (12) is defined in the top face (101) and communicates with the cavity.

The telescoping post (20) is mounted on the center of the top face (101) of the base (10) and is composed of a stationary outer tube (21), a first inner tube (22) and a second inner tube (23).

The stationary outer tube (21) is attached to the center of the top face (101) of the base (10) and has a diameter, a top end and a bottom end. The bottom end of the stationary outer tube (21) is firmly attached to the top face (101) of the base (10). The top end of the stationary outer tube (21) has a flange (211), a slot (213) and a bridge (212). The flange (211)

extends out from the top end. The slot (213) is defined longitudinally in the stationary outer tube (21) near the top end and passes radially out through the flange (211). The bridge (212) is formed across the slot (213) at the top end of the stationary outer tube (21). The bridge (212) is preferably a roller.

The first inner tube (22) is mounted slidably inside the stationary outer tube (21) and has a diameter, a bottom end (221), a separator sleeve, a reeve hole and a top end (222). The separator sleeve is mounted around the bottom end of the first inner tube (22) and slidably inside the stationary outer tube (21) to maintain a gap between the first inner tube (22) and the stationary outer tube (21) and has a bottom end and a top end. The bottom end of the separator sleeve is flush with the bottom end (221) of the first inner tube (22). The reeve hole is defined through the first inner tube (22) near the top of the separator sleeve. The top end (222) of the first inner tube (22) has a slot and a bridge. The slot is formed longitudinally in the first inner tube (22) near the top end (222). The bridge is formed across the slot at the top end (222) and is preferably a roller.

The second inner tube (23) is mounted slidably inside the first inner tube (22) and has a diameter, a bottom end (231), a separator sleeve, a reeve hole and a top end (232). The separator sleeve is mounted around the bottom end of the second inner tube (23) and slidably inside the first inner tube (22) to maintain a gap between the second inner tube (23) and the first inner tube (22) and has a bottom end and a top end. The bottom end of the separator sleeve is flush with the bottom end (231) of the second inner tube (23). The reeve hole is defined through the second inner tube (23) near the top of the separator sleeve.

The reel assembly (30) comprises a reel and a cable (31). The reel has a prime mover and a spool (32). In the embodiment being described, the prime mover is a motor (321). The motor (321) is mounted in the cavity in the base (10) and rotates the spool (32). The cable (31) has a proximal end and a distal end and is wound on the spool (32). The proximal end is attached to the spool (32) and the cable (31) passes over the bridge (212) at the top end of the stationary outer tube (21), down through the gap between the stationary outer tube (21) and the first inner tube (22) and into the first inner tube (22) via the reeve hole at the bottom end (221). The cable (31) continues and passes up through the gap between the stationary outer tube (21) and the first inner tube (22), through the slot in the first inner tube (22) and over the bridge at the top end (222) of the first inner tube (22). Lastly, the cable (31) extends down through the gap between the first inner tube (22) and the second inner tube (23) and is attached to the bottom end (231) of the second inner tube (23).

Figure 3:
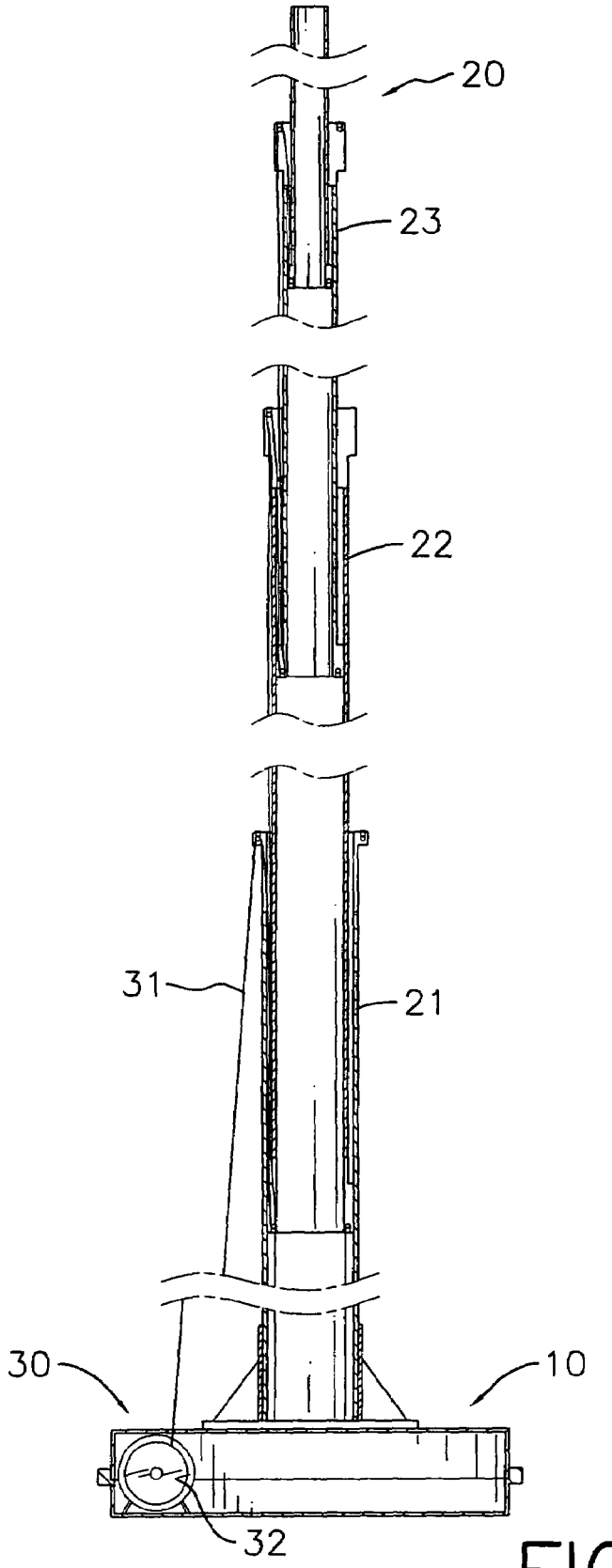
FIG. 3 is an operational side view in partial section of the adjustable trunk in FIG. 1 with the trunk extended.

With further reference to FIG. 3, the adjustable trunk is extended by starting the motor (321), rotating the spool (32) and winding the cable (31) onto the spool (32). As the cable (30) is shortened, the distal end of the cable (30) raises the second inner tube (23). When the second inner tube (23) is completely extended, the cable (31) passing through the reeve hole in the first inner tube (22) raises the first and second inner tubes (22, 23). When the first inner tube (22) is completely extended, the trunk is extended in height.

The trunk is retracted by rotating the spool (32) in the opposite direction winding the cable (31) off the spool (32). As the cable (31) off the spool (32) lengthens, gravity retracts the inner tubes (22, 23) into the stationary outer tube (21).

Figure 4:
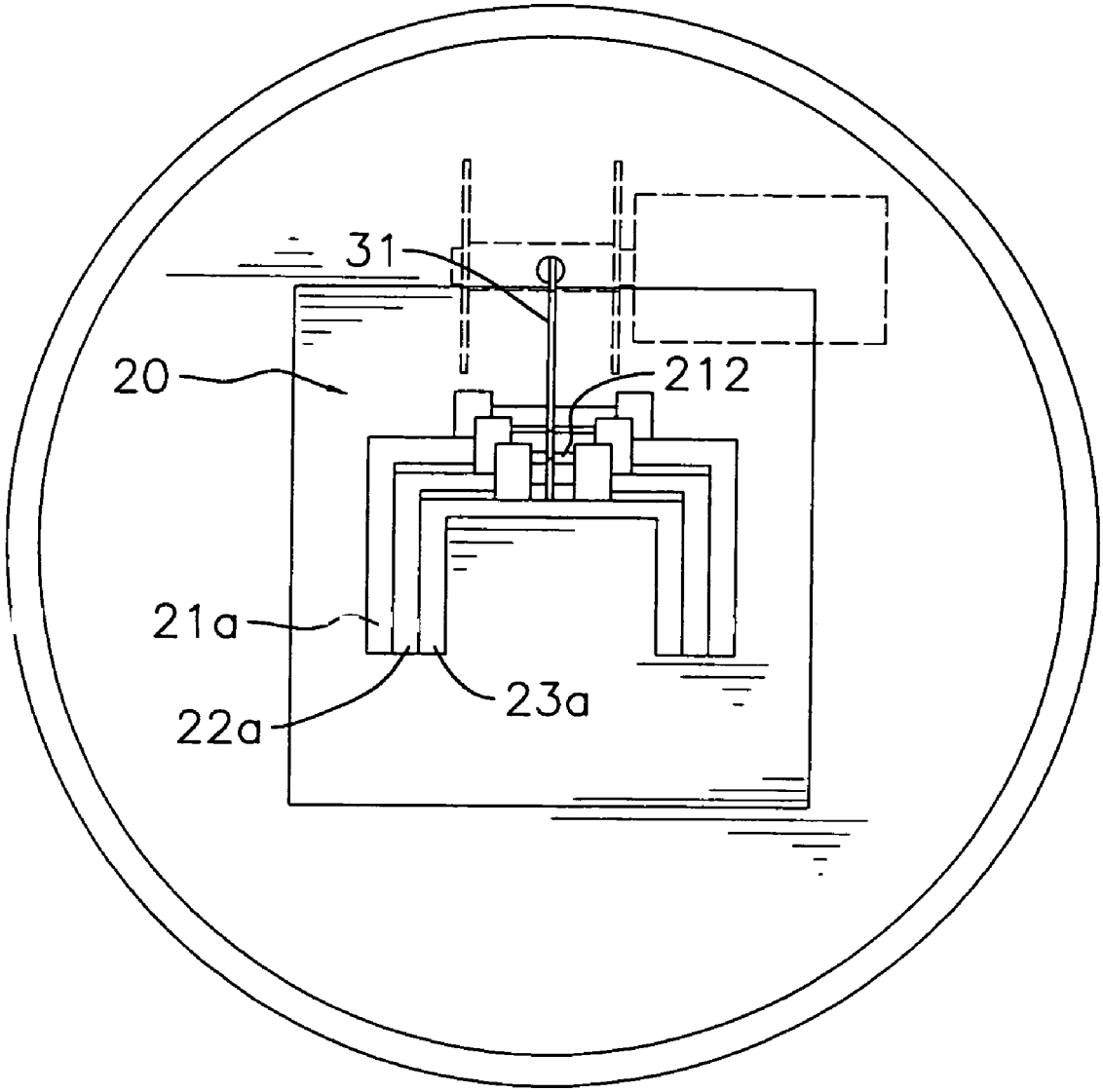
FIG. 4 is a top view in partial section of another embodiment of the adjustable trunk for an artificial Christmas tree in accordance with the present invention.
Figure 5:
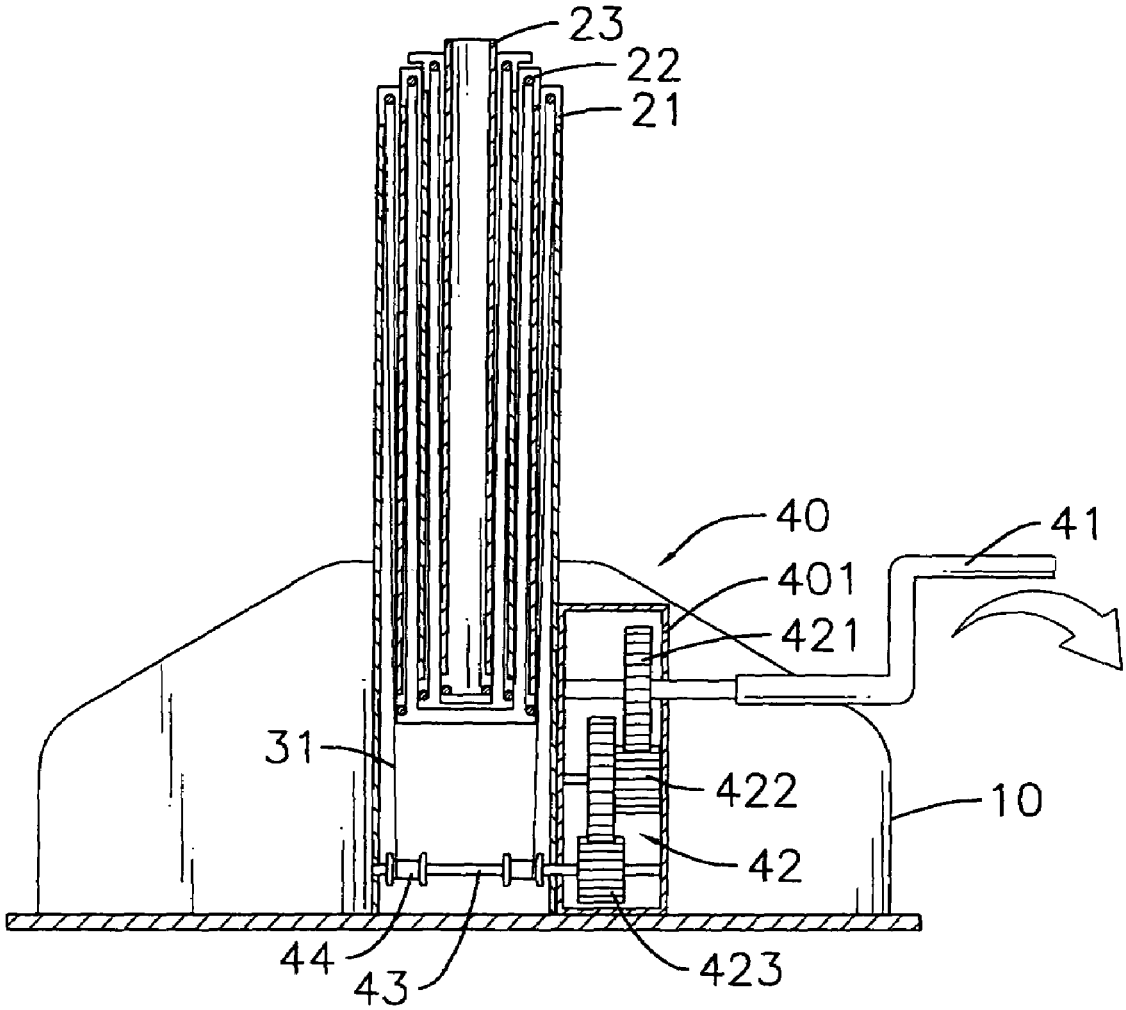
FIG. 5 is a side view in partial section of another embodiment of an adjustable trunk for an artificial Christmas tree in accordance with the present invention.
Figure 6:
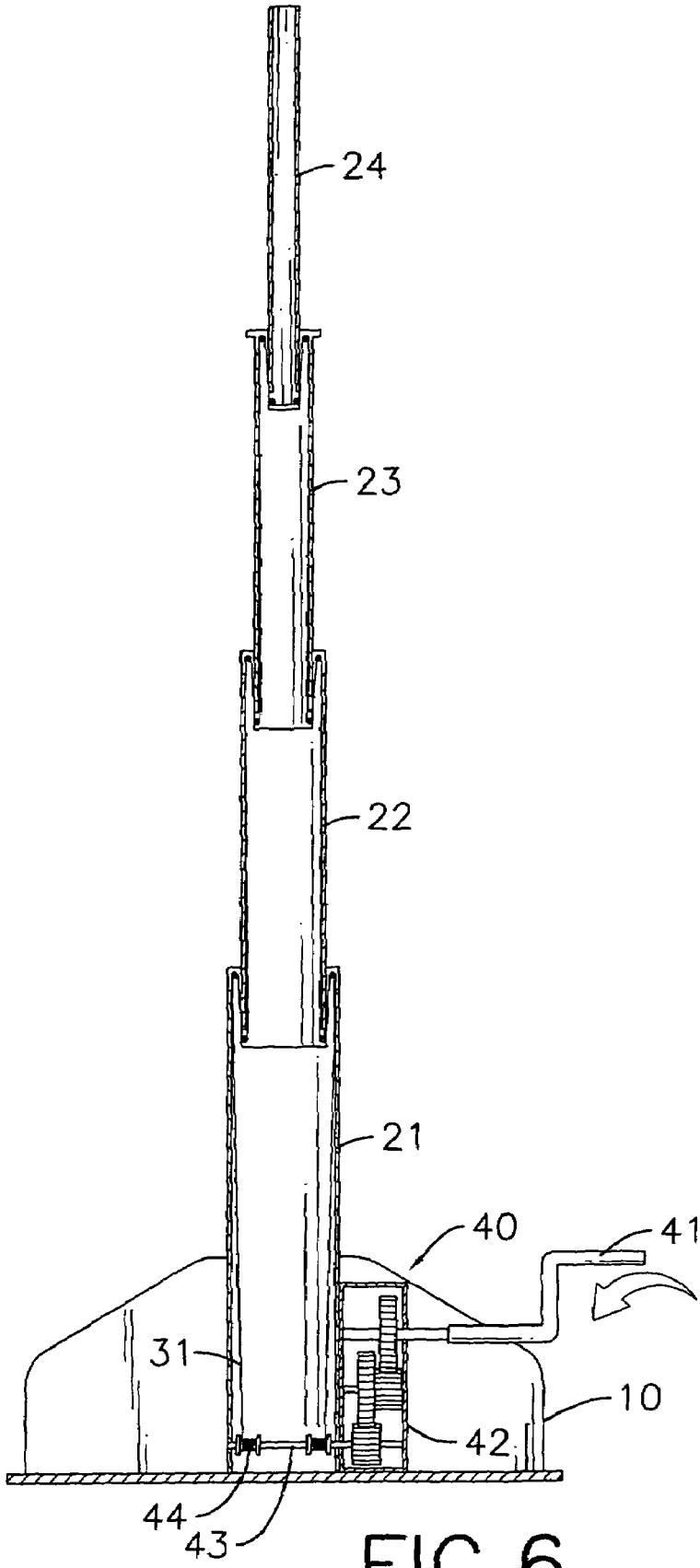
FIG. 6 is an operational side view in partial section of the adjustable trunk in FIG. 5.
Figure 7:
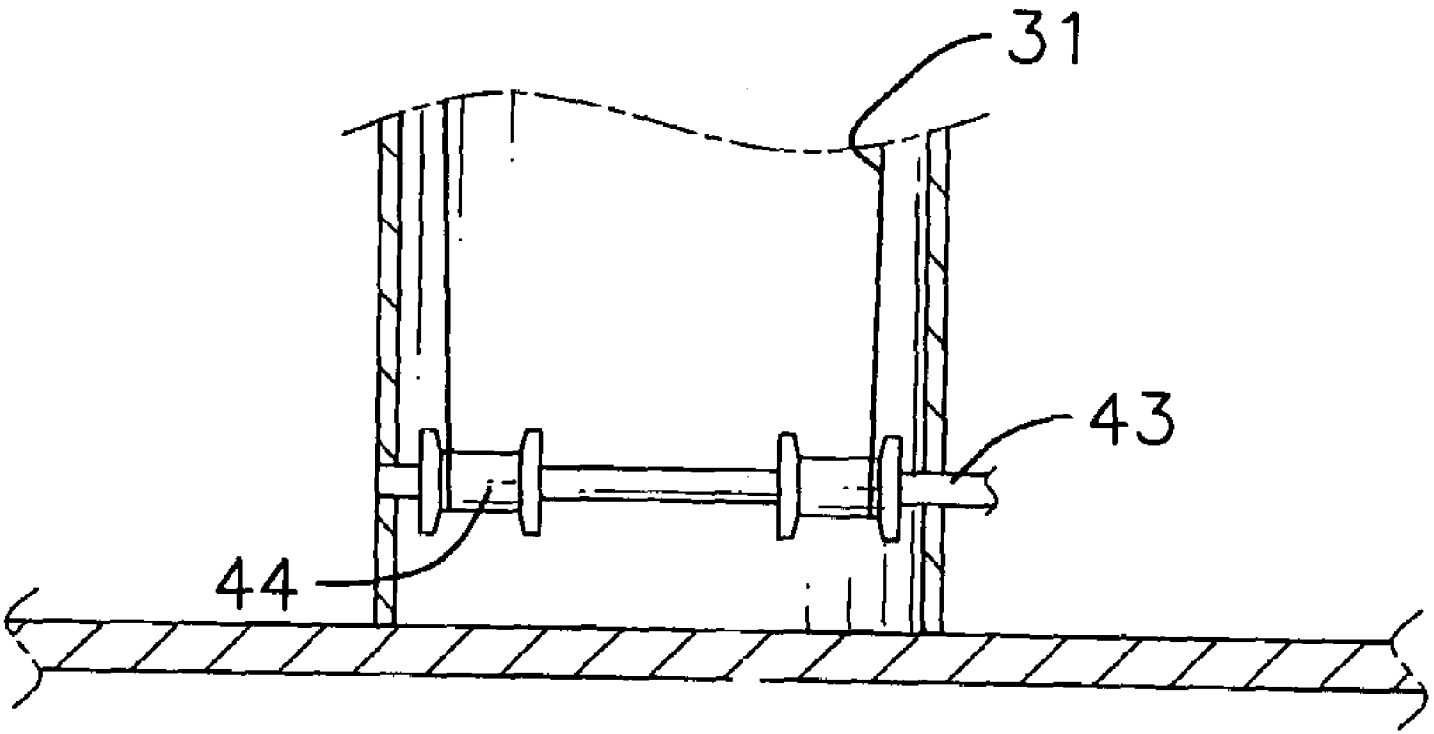
FIG. 7 is an enlarged side view in partial section of spools mounted in a stationary outer tube of the adjustable trunk in FIG. 5.
Figure 8:
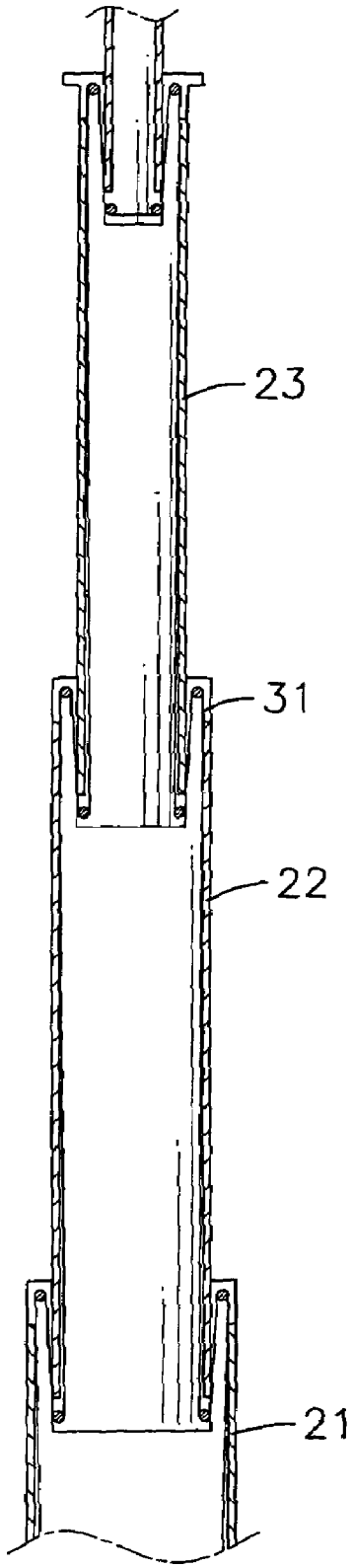
FIG. 8 is an enlarged cross-sectional side view of inner tubes of the trunk in FIG. 5 extended.

With reference to FIG. 4, another preferred embodiment of the adjustable trunk in accordance with the present invention has the same structure as the previously described embodiment of the adjustable trunk except the tubes (21, 22, 23) are U-shaped rails (21*a*, 22*a*, 23*a*).

With reference to FIGS. 5 to 8, still another preferred embodiment of the adjustable trunk for a Christmas tree in accordance with the present invention has a similar structure except the reel assembly is a manually cranked reel (40), and the cable (31) is completely contained inside the telescoping post (20).

The manually cranked reel (40) is composed of prime mover and two spools (44). The prime mover is mounted beside the stationary outer tube (21) inside the base (10) and has a casing (401), a gear assembly (42), a crank handle (41) and a drive shaft (43) The casing (401) is formed beside the stationary outer tube (21). The gear assembly (42) has multiple gears including a crank gear (421), an intermediate crown gear (422) and a drive shaft gear (423) rotatably mounted in the casing (401). The crank handle (41) is mounted rotatably through the casing (401) and is connected to and rotates the crank gear of the gear assembly (42). The driving shaft (43) is mounted rotatably through the casing (401), is securely mounted through and rotated by the drive shaft gear and rotatably extends through the bottom end of the stationary outer tube (21). The two spools (44) are mounted securely on the drive shaft (43) inside the stationary outer tube (21). A cable (31) is attached to and is wound on each spool (44). The cables (31) extend up into the gap between the stationary outer tube (21) and the first inner tube (22), pass respectively through the longitudinal slots (213) as shown in FIG. 1, around the bridges and back down through the gap and through the reeve holes near the bottom end of the first inner tube (22). The cables (31) are threaded through the gaps, out the slots, around the bridges and through the reeve holes until the cables (31) are connect to the reeve hole near the bottom of an innermost tube (24).

Although the invention has been explained in relation to its preferred embodiment, many other possible modifications and variations can be made without departing from the spirit and scope of the invention as hereinafter claimed.

What is claimed is:

1. An adjustable trunk for an artificial Christmas tree comprising:

a base having
- a top face having a center; and
- a cavity defined inside the base;

a telescoping post mounted on the top face at the center of the base and having
- a stationary outer tube mounted on the top face of the base and having a top end and a bottom end;
- at least two inner tubes with different diameters mounted slidably inside the stationary outer tube and each other, each of the at least two inner tubes having a top end;
- at least one longitudinal slot formed near the top end of the inner tube;
- at least one bridge closing the longitudinal slot at the top end of the inner tube;
- a bottom end; and
- a reeve hole formed through the inner tube near the bottom end of the inner tube;
- a gap defined between the stationary outer tube and an adjacent inner tube of the at least two inner tubes;
- an inner gap defined between each pair of adjacent two inner tubes of the at least two inner tubes; and a reeling assembly attached to the base, connected to the telescoping post and having
- a reel attached to the base and having a prime mover; and at least one spool driven by the primer mover; and at least one cable wound respectively on the at least one spool extending over the top end of the stationary outer tube, passing downward through the gap between the stationary outer tube and an outermost inner tube of the at least two inner tubes, through the reeve hole at the bottom end into the outermost inner tube, up through the inner gap formed by the outermost inner tube and a next inner tube of the at least two inner tubes, out through the longitudinal slot at the top end of the outermost inner tube, over the bridge and back into the inner gap, repeatedly through the other sequential inner tubes and attaching to the reeve hole near the bottom end of an innermost inner tube of the at least two inner tubes lastly.

2. The adjustable trunk as claimed in claim 1, wherein the reel has a spool and a motor attached to the spool.

3. The adjustable trunk as claimed in claim 1, wherein the reel assembly is a manually cranked reel comprising:

a prime mover mounted beside the stationary outer tube inside the base and having a casing formed beside the stationary outer tube;

a gear assembly multiple gears including a crank gear, an intermediate crown gear and a drive shaft gear rotatably mounted in the casing;

a crank handle mounted rotatably through the casing and connected to and rotates the crank gear of the gear assembly; and a drive shaft mounted rotatably through the casing, securely mounted through and rotated by the drive shaft gear and rotatably extending through the bottom end of the stationary outer tube; and two spools mounted on the drive shaft inside the stationary outer tube; and two cables are attached respectively to and wound respectively on the two spools to connected between the stationary outer tube and the at least two inner tubes via the gaps until being connected to the reeve hole near the bottom of the innermost inner tube.

* * * * *